US005144970A

United States Patent [19]

Seidel et al.

[11] Patent Number: 5,144,970

[45] Date of Patent: Sep. 8, 1992

[54] SELF OPENING UMBRELLA

[75] Inventors: Joachim Seidel, Solingen; Klaus Stiller, Langenfeld, both of Fed. Rep. of Germany

[73] Assignee: Kortenbach Verwaltungs-und Beteiligungsesellschaft mbH & Co., Solingen, Fed. Rep. of Germany

[21] Appl. No.: 594,025

[22] Filed: Oct. 9, 1990

[30] Foreign Application Priority Data

Feb. 13, 1990 [DE] Fed. Rep. of Germany ..... 4004349

[51] Int. Cl.[5] ..... A45B 25/14

[52] U.S. Cl. ..... 135/22; 135/28

[58] Field of Search ..... 135/25.3, 25.34, 29, 135/22-24, 28, 25.4, 37, 38, 39

[56] References Cited

U.S. PATENT DOCUMENTS

| | | | |
|---|---|---|---|
| 920,505 | 5/1909 | Umstead | 135/25.33 X |
| 3,746,025 | 7/1973 | Murata | 135/25.33 X |
| 3,837,352 | 9/1974 | Weber | 135/25.33 X |
| 3,902,514 | 9/1975 | Weber | 135/25.33 X |
| 4,007,753 | 2/1977 | DeMarco | 135/25.33 |
| 4,676,262 | 6/1987 | Yang | 135/25.3 |
| 4,739,783 | 4/1988 | Yang | 135/25.3 |
| 4,766,917 | 8/1988 | Yang | 135/25.3 |
| 4,966,180 | 10/1990 | Lai | 135/26 X |

FOREIGN PATENT DOCUMENTS

| | | | |
|---|---|---|---|
| 0230494 | 8/1987 | European Pat. Off. | 135/25.3 |
| 1940821 | 6/1970 | Fed. Rep. of Germany | 135/25.33 |
| 3809873 | 10/1989 | Fed. Rep. of Germany | 135/25.3 |

*Primary Examiner*—David A. Scherbel
*Assistant Examiner*—Lan Mai
*Attorney, Agent, or Firm*—Samuel Meerkreebs

[57] ABSTRACT

The invention relates to a self opening umbrella having canopy rods (D) which can be shortened in at least a twofold manner and having a stick (1) which is telescopic in at least two stages and has on it a displaceable slider (2), to which lower struts (3) of the canopy linkage are linked, and having a drive spring (F) for raising the slider and opening the frame. In order to reduce the manual force required when pulling the slider down upon closing the umbrella canopy and also to minimize the sliding friction of the spring on the stick, the spring (F) is to supported with its lower end (F') on a rigid abutment (W) of the stick (1) and acts on a crown (20) which is displaceable axially relatively to the top of the stick.

12 Claims, 2 Drawing Sheets

SELF OPENING UMBRELLA

BACKGROUND OF THE INVENTION

Field of Invention

The invention generally relates to self-opening, collapsible, foldable and shortentable umbrellas.

The invention relates, more particularly to a self opening umbrella having canopy-supporting rods, which can be shortened in at least a twofold manner; and a stick which is telescopic in at least two stages and carries a displaceable slider, to which lower struts of a canopy linkage are linked. The frame is opened by a compression spring working axially of the stick between two relatively movable parts and is closed by pulling the slider down the stick against the action of the spring.

A self opening umbrella of this kind is collapsible and shortenable and thus, one of the pocket type, as, for example, known from the U.S. Pat. No. 4,676,262. In this model, the drive spring is located directly under the umbrella crown, which is fixed on the stick; and it acts upon an auxiliary slider. Since the displacement path of this spring below the umbrella crown is relatively short when opening and closing the umbrella, the stick is largely unaffected by wear-erosion and scratches in contrast to self opening umbrellas of other models, for example, in which the drive spring is disposed between main and auxiliary sliders, and moves up and down over almost the entire stick length when opening and closing the umbrella. Nevertheless, in both constructions the drive spring requires a relatively high force when retracting the main slider during the closing movement and it is difficult for the user to maintain a grip on the slider and complete the closing movement of the slider down towards the handle at the lower end of the stick.

SUMMARY OF THE INVENTION

The underlying object of the invention is to provide a self opening umbrella which requires low manual force or effort when retracting the slider and closing the umbrella canopy.

In accordance with the invention, a self opening umbrella comprises a telescopic stick; a ring fixed on the stick adjacent to the upper end of the stick; canopy-supporting rods, which are shortenable in at least a two fold manner, and which are pivotally connected at their inner ends to the ring; a slider which is displaceable along the stick beneath the ring; lower struts pivotally interconnecting the slider and rods; a crown above the ring and displaceable axially of the stick; upper struts pivotally interconnecting the crown and rods; and a compression spring interposed between the crown and an abutment fixed relatively to the stick.

In this manner, a drive mechanism for the opening of the canopy of a shortenable or so-called pocket umbrella is obtained, which requires merely a single slider, namely the slide for the retraction of the canopy and the parallel compression of the drive spring. The canopy rods pivot around non-shiftable bearings at a rigid abutment instead of a shiftable bearing on a second auxililiary slider as is known in the prior art. Consequently the canopy rods always move around one and the same place on the stick. Therefore, the usual second slider is superflous. The drive spring does not have any downwards extension at its lower support. The spring from the rigid abutment is extensible in the direction to the crown and from the crown to the abutment. Due to the open arrangement of the drive spring any frictional force of it against the stick and any unsightly scratching of the later is avoided. When released, the drive spring lifts the crown away from the abutment, so that the canopy rods borne thereupon move upwards. The compression of the drive spring takes place along with the sinking of the crown by the retraction of the single manual slider and consequently, from the upper end of the drive spring downward. For this reason, and in consequence of the aforesaid kinetic arrangement, retraction force is approximately equal to its opening force. Consequently, a lesser force is required when retracting the slider and closing the umbrella canopy and, consequently again, operation is facilitatad. Due to achieved balance the drive spring can also be designed to be stronger in order to effect the opening in a more efficient manner, if required.

The abutment may be formed by the ring.

Alternatively, the drive spring can be supported directly on the stick and, by this means, the circumferential volume of the closed and collapsed umbrella can be reduced in that the abutment is a stop located on or in the stick.

A further reduction of the circumferential volume of closed umbrella can result if the lower end of the spring is received into the stick.

The crown may have a spigot of which is guided displaceably in the upper end of the stick. The upper end of the spring may be received within a cavity in the crown. In that case, the upper end of the stick guiding the spigot may project beyond the ring but, in the closed state of the umbrella, is also received in the cavity in the crown.

The ring may be provided with a casing for the lower end of the spring, the casing being anchored on the stick by means of a shaping of the stick engaging the casing.

The invention also includes an umbrella incorporating a canopy cover supported by a frame in accordance with the invention, wherein the rods can be shortened in a threefold manner, the rods being secured with the canopy spread by a respective over centre catch in a stable position by virtue of a pivotal joint between a control rod and a lever arm of a respective first parallelogram linkage passing through an over centre position in relation to a diagonal between pivots of that linkage, the lever arm being an extension of a link of an adjacent parallelogram linkage, and the stable position being maintained by radial tension in the cover.

Each over centre catch may then be releasable released by an anti lock device by virtue of the pivotal joint connecting the control rod and the lever arm being constructed as a pin and slot connection which, when closing the umbrella frame, in the first phase of release of the canopy, jerks the pin out of the over centre position through the diagonal owing to the tendency of the lower struts to spread and the corresponding radial displacement of the control rods.

The invention is explained in greater detail below with reference to an exemplary embodiment illustrated in the accompanying drawings, in which:

DESCRIPTION OF A PREFERRED EMBODIMENT(S)

Figures 1, 2:
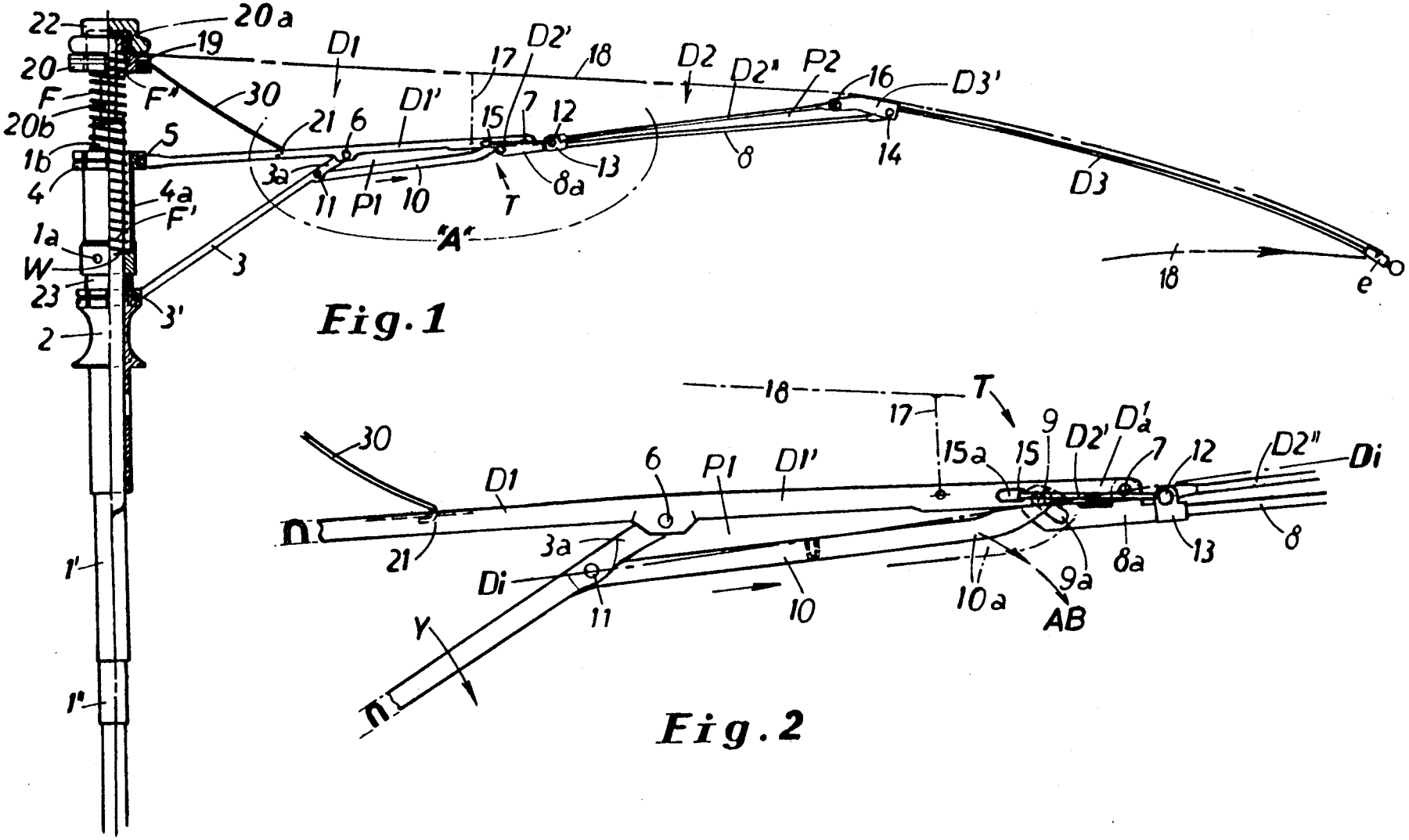
FIG. 1 shows in elevation half of a self opening umbrella constructed according to the invention with opened canopy.
FIG. 2 is an enlarged view of the portion "A" in FIG. 1.

The invention can be put into effect irrespective of whether the canopy rods consist of two, three or four hinged and/or telescopic members and, accordingly, foldable and/or slidable constructions. In the case of the exemplary embodiment illustrated, the invention is used in conjunction with a shortenable umbrella which can be folded in a threefold manner. The frame has canopy rods each consisting of inner, central and outer parts D1, D2 and D3, respectively, which can be folded onto one another and, extend from a central fixing ring 4, to the peripheral ends e of the canopy rod parts D3. A stick 1 can have at least two telescopic parts 1' and 1'' on which a main slider 2 is displaceable upwards and downwards. The latter serves for retracting the open umbrella canopy when it is pulled down along the stick 1. Pivoted at joints 3' on the main slider 2 are lower struts 3 which, via pivot joints 6, support the inner canopy rod parts D1 from below. These rod parts D1 are hinged to the central fixing ring 4 at pivot joints 5.

For the purposes of clear representation, the drawings only show one of the canopy rod formations which extend radially and are arranged around an umbrella crown 20.

At its outer end, each inner canopy rod D1 is connected via a pivot joint 7 to a short lever arm **8*a* of a control link 8 for the respective central canopy rod part D2. The short lever arm 8*a* is connected to a control rod 10 by a pivot joint 9. The joint 9 has a pin which is guided displaceably in a slot 9*a* in such a way that the lever arm 8*a* and an end 10*a* of the control rod 10 can enter a U shaped profile of the canopy rod part D1 when the umbrella canopy is opened and can contact the base of this profile; see at the left-hand end of FIG. 2; the pin of the joint 9 situated in the end 10*a* coming to rest above the connection diagonal Di and, consequently, in an above dead centre position in relation to both the pivot joint 7 and a pivot joint 11 between the rod 10 and the strut 3. In this position enforced by the tension in a canopy cover 18, any leverage of the control rod 10 on the short lever arm 8*a* in the closing direction of the canopy is eliminated and thus also the canopy is held in its optimally stable flat open position shown in FIGS. 1 and 2 under the tension in the canopy cover 18**.

However, the pin/slot connection 9, **9*a* also has the effect of an anti-lock device AB. It releases an over centre catch T, described above, as soon as the initial phase of the closing of the canopy begins upon pulling down of the main slider 2. At this time, the lower strut 3 is spread in the direction of the arrow Y and the control rod 10 is displaced radially outwards so that the joint pin 9 in the slot 9*a* of the lever arm 8*a* is inevitably also jerked downwards through of the dead centre position described above to a position below the connection diagonal Di, as shown by the arrow AB in FIG. 2. Accordingly, at the same time as the release of the canopy cover 18, the held open position of the unbrella canopy is already released and the required lever engagement on the short lever arm 8*a* in relation to the joint 7 is reestablished so that, when the main slider 2** is pulled down further, the entire subsequent closing movement of the canopy can take place smoothly.

Figure 5:
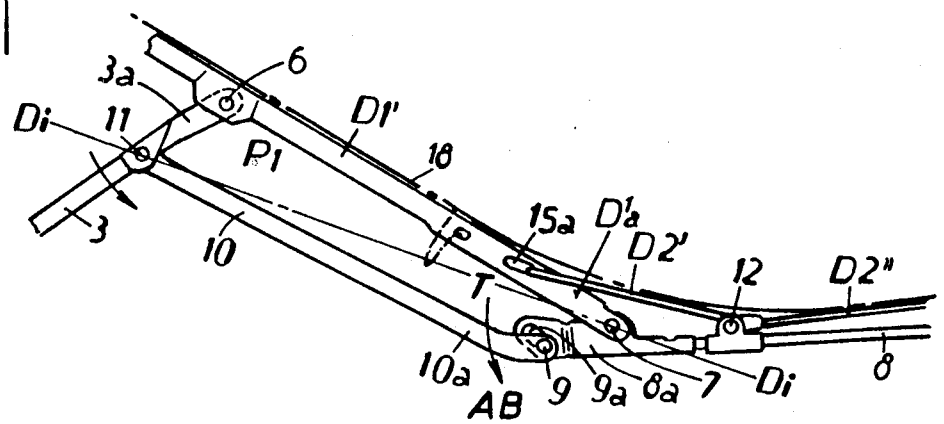
FIG. 5 is an enlarged view of the portion "B" in FIG. 4.

A portion D1' of the inner canopy rod part D1 and the control rod 10 form the long links, and the short lever arm **8*a* with a portion 3*a* of the strut 3 located between the joints 6 and 11 form the short links, of a first parallelogram linkage P1; see FIG. 5**.

Each central canopy rod part D2, extending approximately parallel to the respective control link 8, consists of two portions D2' and D2''. These are pivotally interconnected by a joint 12 and guided displaceably by means of a slide element 13 on the control link 8; see FIGS. 1 and 2. At its outer end, the control link 8 is pivotally connected by a joint 14 to the respective outer canopy rod part D3. The part D2' is pivotally connected by a joint 15 to the respective inner canopy rod part D1 while the portion D2'' engages a short lever arm D3' of the outer canopy rod part D3 via a pivotal joint 16. Accordingly, the central canopy rod part D2 with its two portion D2' and D2'', together with the control link 8, form the long links, and the short lever arm D3' of the outer canopy rod part D3 with the short lever arm D1*a* between the joints 7 and 15 form the short links of a second parallelogram linkage P2. The joint 15 can be combined with a guide slot **15*a*, in which the part D2' is displaceable in the form of a hairpin for the purpose of achieving a length compensation during the changing of part positions according to FIGS. 3 and 1**.

The central fixing ring 4 is connected to the stick 1, fixed in terms of rotation and displacement, by means of a transverse pin or a shaping **1*a* embossed out of the stick 1 in the form of a tab or a nipple. The fixing ring 4 can be provided with a spring housing 4*a* shown partly in section in FIGS. 1 and 3, and can provide a lower abutment W for the lower end F' of a drive spring F. The spring is supported with its upper end F'' inside a cavity 20*a* of the crown 20 (compressed) and is consequently stressed and released or relaxed between the abutment W, fixed to the stick, and the crown 20 and serves as a motor for opening the umbrella canopy. The crown 20 can be guided displaceably by means of a spigot 20*b* extending into the stick 1, or it can be supported over an end 1*b* of the stick non positively without such a guide simply by the drive spring F and held freely suspended over the end 1*b* of the stick by the radial arrangement of upper struts 30 about the crown. The upper struts 30 are hooked rotatably on to the crown 20 and in the respective inner canopy rod parts D1 and, consequently, connected by pivotal joints 19 and 21. In this manner, the crown 20 upon opening and closing of the canopy is raised and lowered in relation to the stick 1 and the fixing ring 4 and, correspondingly, the drive spring F is also released and relaxed (FIG. 1) and stressed (FIG. 3**).

The drive spring F can also be sunk into the stick 1 and can contact an abutment W', fixed to the stick, with its lower end F' on a transverse pin or tab **1*c* or an annular groove of the stick 1. The end 1*b* of the stick can protrude beyond the fixing ring 4 in the form of a projection and, together with the upper end F' of the drive spring F, can be completely received in the cavity 20*a* of the crown 20** in the closed position of the umbrella canopy.

Figure 4:
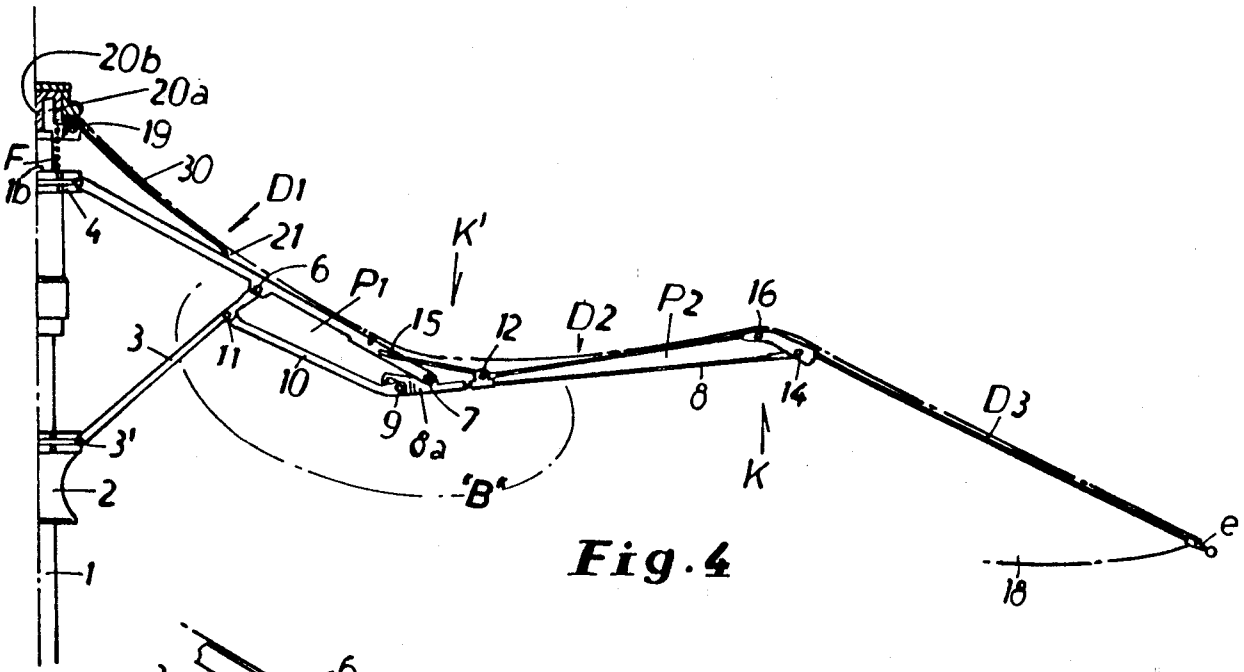
FIG. 4 shows the half umbrella with half opened umbrella canopy.

The canopy is opened automatically with displacement of the main slider 2 on the stick 1 into the opened position according to FIG. 1 after releasing the slider 2 by means of a triggering device not shown but which is known per se. The canopy can be collapsed by pulling down the slider 2 by hand into the closed position according to FIG. 3. During collapsing; as seen in FIG. 4, the canopy rod parts D1 and D2 form a bend K' and, at the same time, the canopy cover 18 which is connected to the canopy rod part D1 by means of a thread 17; see FIG. 1, is also pulled in and folded. The outer canopy rod parts D3 collapse at a bend K against the canopy rod parts D2 during the closing so that, in folded position, they point with their ends e down towards an umbrella handle (not shown) at the bottom of the stick 1.

Figure 3:
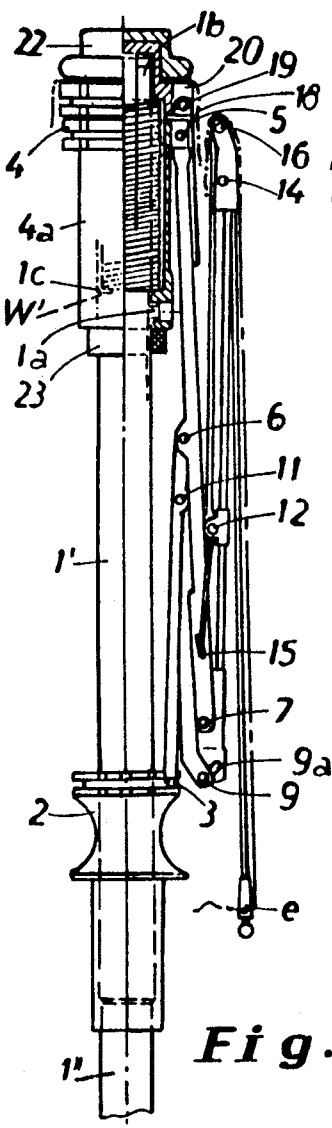
FIG. 3 shows the half umbrella according to FIG. 1, but in the closed or folded state of the umbrella canopy.

The U shaped profiling, already described, of the canopy rod parts D1 and D2, of the struts 3 and of the control rods 10 can be effected in such a way that these parts enter completely or at least predominantly inside one another in the closed state of the umbrella canopy according to FIG. 3 and, in this manner, in conjunction with the encapsulated structure of the opening mechanism at the tip of the umbrella result in a bundle of small and compact volume. The canopy cover 18 is fixed to the crown 20 by means of a cap 22. An annular shock absorber 23, arranged under the central fixing ring 4, absorbs the stop-energy of the main slider 2 on the fixing ring 4 when moving to the opened position of the canopy.

We claim:

1. A self-opening umbrella frame comprising a telescopic stick; a ring fixed on the stick adjacent the upper end of the stick; canopy-supporting rods which are shortenable in at least a two-fold manner, the rods being pivotally connected at inner ends to the ring; a slider displacable along the stick below said ring; lower struts pivotally interconnecting the slider and the rods; a crown above the ring and displacably supported axially of said stick; upper struts pivotally interconnecting the crown and rods; and a compression spring interposed between the crown and an abutmentment fixed relative to the stick; said frame being self-opening primairly as a result of expansion of the spring from a compressed condition by applying tension through the upper struts to the rods, and being closable by manually pulling the slider down the stick for recompressing the compression spring for subsequent automatic reopening.

2. An umbrella according to claim 1, in which the abutment is formed by the ring.

3. An umbrella according to claim 1, in which the abutment is a stop located on the stick.

4. An umbrella according to claim 3, in which the lower end of the spring is received within the stick.

5. An umbrella according to claim 1, in which the crown has a spigot of which is guided displaceably in the upper end of the stick.

6. An umbrella according to any one of the preceding claims, in which the upper end of the spring is received within a cavity in the crown.

7. An umbrella according to claims 5, in which the upper end of the stick guiding the spigot projects beyond the ring and, in the closed state of the umbrella, is received within the cavity in the crown.

8. An umbrella according to any one of the preceding claims, in which the ring is provided with a casing for the lower end of the spring, the casing being anchored on the stick by means of a shaping of the stick engaging the casing.

9. An umbrella incorporating a canopy cover supported by a frame according to any one of the preceding claims, in which the rods can be shortened in a threefold manner, the rods being secured with the canopy spread by a respective over centre catch in a stable position by virtue of a pivotal joint between a control rod and a lever arm of a respective first parallelogram linkage passing through an over centre position in relation to a diagonal between pivots of that linkage, the lever arm being an extension of a link of an adjacent parallelogram linkage, and the stable position being maintained by radial tension in the cover.

10. An umbrella according to claim 9, in which each over centre catch can be released by an anti lock device by virtue of the pivotal joint connecting the control rod and the lever arm being constructed as a pin and slot connection which, when closing the umbrella frame, in the first phase of release of the canopy, jerks the pin out of the over centre position through the diagonal owing to the tendency of the lower struts to spread and the corresponding radial displacement of the control rods.

11. An umbrella according to claim 1, in which the abutment is a stop located in the stick.

12. An umbrella according to claim 11, in which the lower end of the spring is received within the stick.

* * * * *